US006504379B1

(12) United States Patent
Jackson

(10) Patent No.: US 6,504,379 B1
(45) Date of Patent: Jan. 7, 2003

(54) CABLE ASSEMBLY

(75) Inventor: Robert J. Jackson, Monroe, WA (US)

(73) Assignee: Fluke Networks, Inc., Everett, WA (US)

( * ) Notice: Subject to any disclaimer, the term of this patent is extended or adjusted under 35 U.S.C. 154(b) by 0 days.

(21) Appl. No.: 09/715,487

(22) Filed: Nov. 16, 2000

(51) Int. Cl.[7] ..... H01H 31/02
(52) U.S. Cl. ..... 324/539; 174/117 F
(58) Field of Search ..... 324/539, 628; 174/103, 104, 105 R, 107, 116, 117 F, 36

(56) References Cited

U.S. PATENT DOCUMENTS 3,634,782 A * 1/1972 Marshall ..... 333/1
4,283,593 A * 8/1981 Piasecki et al. ..... 174/36
4,315,662 A * 2/1982 Greenwood et al. ..... 339/97 C
4,375,379 A * 3/1983 Luetzow ..... 156/52
4,381,420 A * 4/1983 Elliott et al. ..... 174/34
4,441,088 A * 4/1984 Anderson ..... 333/1
4,644,092 A * 2/1987 Gentry ..... 174/36
4,971,574 A * 11/1990 Garcia ..... 439/497
5,008,489 A * 4/1991 Weeks et al. ..... 174/36
5,303,630 A 4/1994 Lawrence
5,380,216 A * 1/1995 Broeksteeg et al. ..... 439/352
5,416,268 A * 5/1995 Ellis ..... 174/36
5,554,038 A * 9/1996 Morlion et al. ..... 439/108
5,743,754 A * 4/1998 Cristich ..... 439/349
6,271,472 B1 * 8/2001 Mattos et al. ..... 174/113 R
6,334,788 B1 * 1/2002 Sakaguchi et al. ..... 439/528

* cited by examiner

*Primary Examiner*—Christine Oda
*Assistant Examiner*—Etienne P LeRoux
(74) *Attorney, Agent, or Firm*—George T. Noe; Richard A. Koske

(57) ABSTRACT

A link cable assembly is provided as an interface between a network cable test instrument and a network to be tested. The link cable assembly includes a link cable that is constructed to minimize cross talk and have long-term high quality reliability. Interchangeable connector personality modules releasably attached to the link cable permit testing networks having different electrical characteristics. Calibration data may be stored within the cable assembly to allow intrinsic "patch cord" return loss to be factored out of network cable measurements.

10 Claims, 2 Drawing Sheets

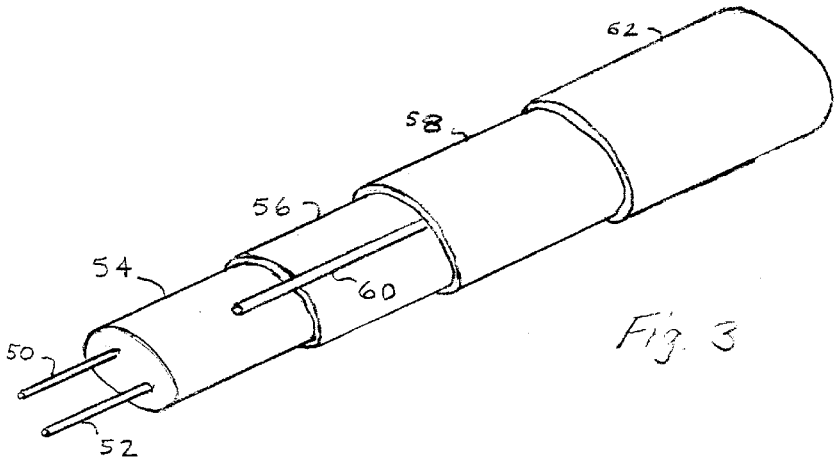
Fig. 3
Fig. 4
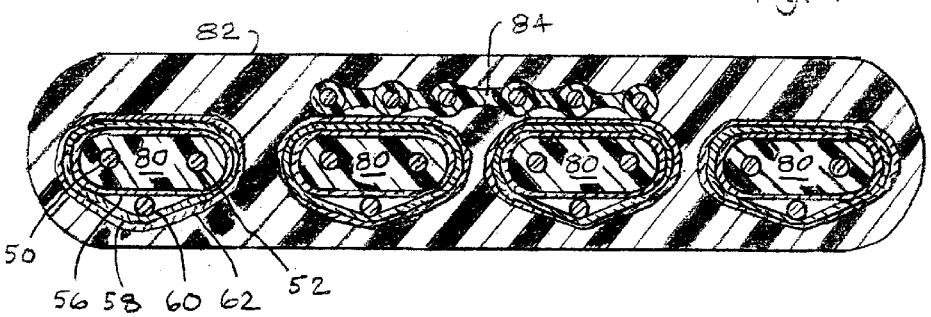
Fig. 5
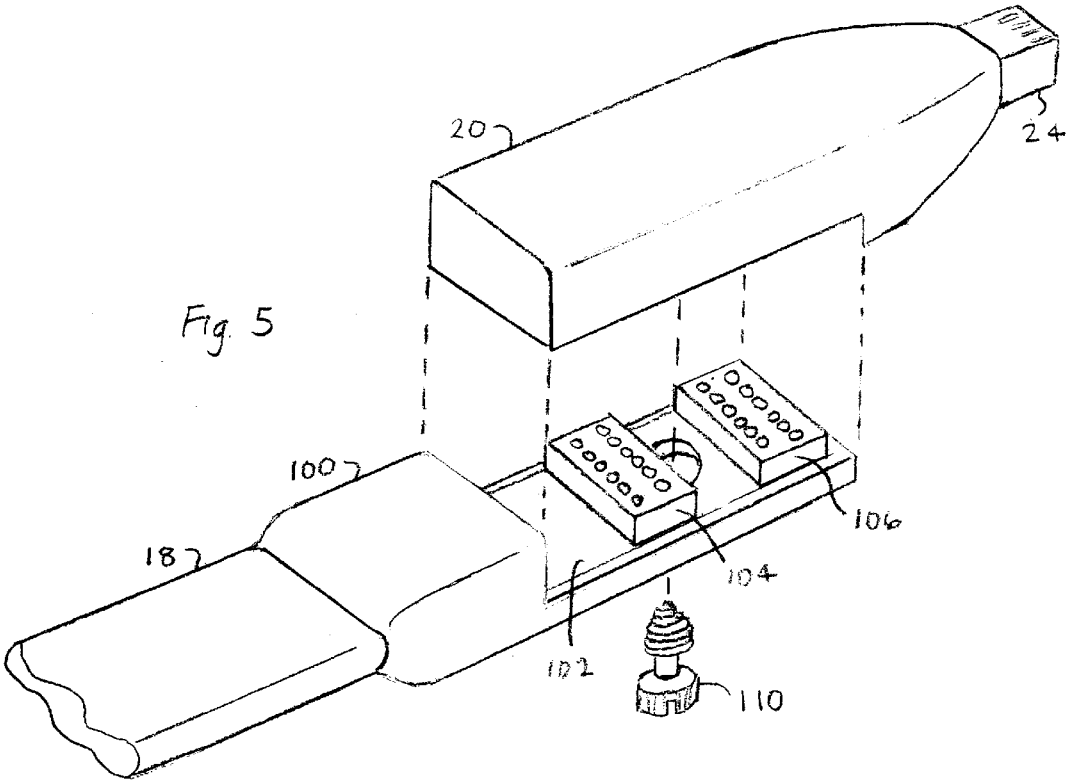

CABLE ASSEMBLY

BACKGROUND OF THE INVENTION

This invention relates generally to network cable testing, and in particular to providing a network cable test instrument with a cable assembly to interface with a network.

To meet the increasing demands for installation and testing of local-area networks (LANs), test equipment must quickly and accurately verify the quality of cabling in the networks and diagnose problems. LANs are typically implemented by physically connecting systems devices, such as computers, printers, etc., together using twisted-wire-pair LAN cables, the most common being what is known as a quad twisted-pair data cable. This type of cable is an unshielded twisted-pair type "UTP" cable which is 8-wire cable configured as 4 twisted pairs. An industry working group known as the Telecommunications Industry Association (TIA) has promulgated standards for the quality and performance of these cables, such as minimum crosstalk isolation and data throughput rates over a range of frequencies.

One prior art network cable test instrument known as the Fluke DSP-4000 connects to a LAN through a link interface cable, which includes a patch cord that is a quad twisted-pair data cable as mentioned above. In fact, this particular tester has the capability of connecting to a variety of networks and connector types by use of interchangeable modules and patch cord links with different types of connectors. The link interface cable, with its patch cord and connector, is typically the most problematic link in terms of reliability and stability, poor performance and unacceptable crosstalk in testing LAN cables. For this reason, the crosstalk response of the near end connector and patch cord is measured to produce mathematical constants that are subsequently used to subtract the undesired cross talk from the measurement. One process for determining near-end crosstalk is described in U.S. Pat. No. 5,532,603, and a process for determining cross talk in a patch cord is described in U.S. Pat. No. 5,821,760. The mathematical constants are stored as calibration data in the interface module so that when the network cable test instrument is in use in its intended measurement environment, it will portray to the cable installer or network specialist an accurate assessment of the cables under test since undesired performance characteristics such as crosstalk associated with interface link and connector will be subtracted off.

Having interchangeable link interface cables, or patch cords with different connectors, allows testing of different LAN systems, but requires the user of the network cable test instrument to carry them all around from job to job. The link interface cables, which may typically be three to six feet in length, may be coiled up when not in use, but still represent considerable bulk. This may be problematic when several different link interface cables must be taken with the network cable test instrument to each test site.

A major disadvantage of prior art link interface cables is that the electrical characterstics of the quad twisted-pair patch cords change with use, affecting the accuracy of measurements. Even coiling and uncoiling the patch cord results in changes of electrical characteristics which may be relatively slight changes each time but accumulate over time. Certainly, events occurring during the normal course of use such as dropping a heavy object on a quad twisted-pair patch cord, or stepping on it, or coiling it too tight, or kinking it will result in physical changes in the twisted pairs, and consequently, in the electrical characterstics. A serious problem is that the user may not even know that the characteristics have been altered and that the accuracy of LAN measurements is affected.

Link interface cables having shielded quad twisted pairs such as that manufactured by Belden Wire and Cable Company and described in U.S. Pat. No. 5,303,630 provide some measure of reduced crosstalk and interference, but do not solve the problem of accumulated changes in electrical characteristics caused by repeated stress on the twisted pairs.

It would be desirable to provide a link interface cable assembly that remains stable with use and minimizes the foregoing problems.

SUMMARY OF THE INVENTION

In accordance with the present invention, a link cable assembly is provided as an interface between a network cable test instrument and a network to be tested.

The link cable assembly includes a link cable having an interface adapter fixedly attached to one end thereof and having an instrument connector for connecting the cable to a test instrument, and one of a number of interchangeable connector personality modules releasably attached to the other end thereof and having a network connector for connecting to a network to be tested by the cable test instrument. The link cable preferably includes a plurality of shielded differential pairs of wire. Each of the plurality of differential pairs of wires comprises two wires arranged in juxtaposition relationship within a dielectric medium, with the wires maintained in constant spatial relationship to provide a nominal 100-ohm characteristic impedance. Shielding is provided to minimize crosstalk and magnetic interference. The plurality of differential pairs of wire are also arranged in juxtaposition relationship within a outer sheath or jacket, resulting in all of the wires being in the same plane, or very close to the same plane. This not only helps in reducing crosstalk, but results in a long lasting and reliable "flat" cable that can be flexed or bent without unduly stressing the differential pairs or permanently changing cable performance characteristics.

Calibration data may be stored in either or both the interface adapter and the connector personality module to permit "patch cord" intrinsic return loss to be effectively removed from the cable measurement over a wide range of frequencies. The data link includes an embedded data cable which permits the test instrument to retrieve identification information and calibration data from memory in the connector personality module. Thus, the link interface cable assembly features interchangeability of connector personality modules while always being calibrated up to the network port.

Other features, and advantages of the present invention will become obvious to those having ordinary skill in the art upon a reading of the following description when taken in conjunction with the accompanying drawings.

BRIEF DESCRIPTION OF THE DRAWINGS

FIG. 3 is an illustration showing the construction details of a single differential pair used in the link cable-portion of the present invention;

FIG. 4 a cross sectional view of the link cable portion of the present invention; and FIG. 5 illustration showing the connection to the link cable of an interchangeable connector personality module.

DETAILED DESCRIPTION OF THE INVENTION

Figure 1:
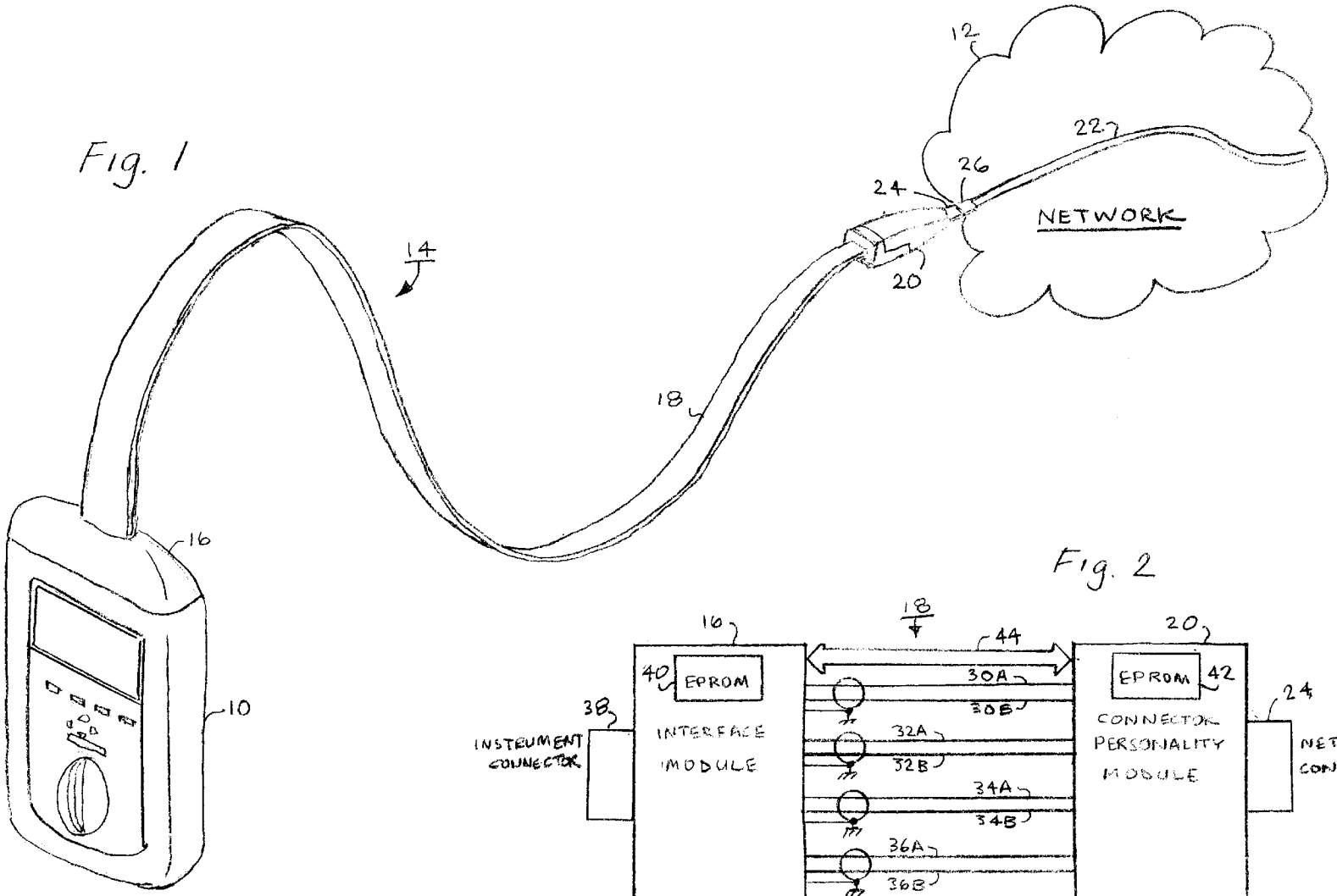
FIG. 1 is an illustration of a LAN cable test instrument connected to a network via a link interface cable-assembly in accordance with the present invention.

Referring to FIG. 1 of the drawings, a network cable test instrument 10 is shown connected to a network 12 via link interface cable assembly 14 in accordance with the present invention. The link interface cable assembly 14 comprises an interface adapter 16 having an instrument connector that connects directly to the cable test instrument 10, interface adapter 16 being fixedly attached to the near end of a link cable 18, and further comprises a connector personality module 20 having a network connector that connects to a network, the connector personality module 20 being releasably attached to the far end of link cable 18. As will become apparent, interface adapter 16, together with link cable 18, may remain with test instrument 10 for long-term use therewith, and the personality module 20 is interchangeable depending on the type of network and connectors to which the cable test instrument will be connected.

For reasons that will become apparent shortly, link cable 18 preferably includes a plurality of shielded differential pairs of wires. A link cable with shielded twisted pairs as taught by the aforementioned U.S. Pat. No. 5,303,630 may also be used with interface adapter 16 and connector personality module 20 if degradation of performance factors or shortened cable life is acceptable.

The connector personality module 20 is representative of a plurality of different personality modules, each of which is provided for a different type of connector, such as a typical RJ-45 connector or a coaxial connector, depending upon the connector at the network port. For this reason, the connector personality module is easily connected to and disconnected from the far end of link cable 18. It should be noted here that "near end" and "far end" in this description relate only to the link interface cable assembly, and not to the network 12 wherein different meanings for these terms may be understood.

Network 12, which may be any local area network such as a typical office environment having desired peripherals such as computer workstations and printers, is represented by an amorphous shape having a cable 22 connecting to personality module 20 at the network port via mating connectors 24 and 26. For impedance matching purposes, we will assume that the both network cabling and link cable 18 have a nominal characteristic impedance of 100 ohms. It should be understood that, while not shown, a remote unit is connected to a far point in the network 12 via another link interface cable as described herein.

Figure 2:
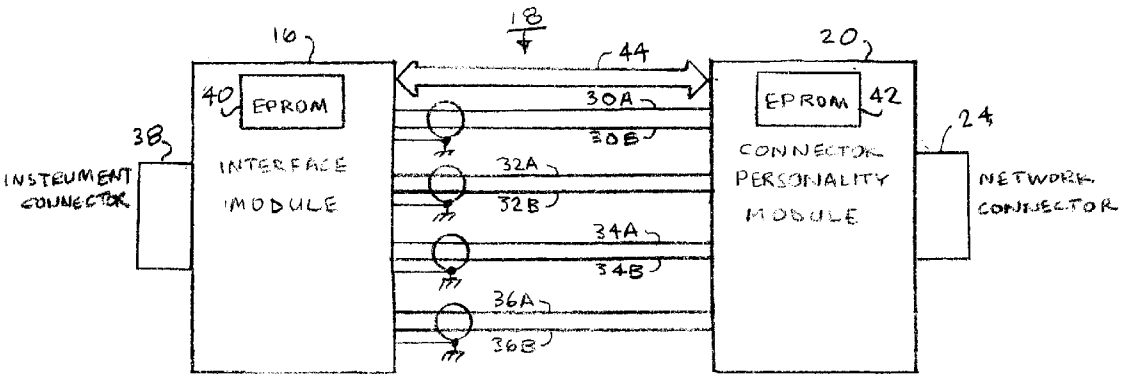
FIG. 2 is a schematic diagram of a link interface cable assembly in accordance with the present invention.

FIG. 2 is a schematic diagram of the link interface cable assembly 14 shown in FIG. 1, including interface adapter 16, link cable 18, and connector personality module 20. A link cable 18 preferably includes a plurality of shielded differential pairs of wires (not twisted pairs), shown as four shielded differential pairs of wires 30A-30B, 32A-32B, 34A-34B, and 36A-36B, each having a nominal characteristic impedance of 100 ohms to match the impedance of the cabling in network 12. It should be noted, however, that shielded (or unshielded) twisted pairs could be used for the link cable as mentioned earlier if reduced electrical performance or shortened cable life is acceptable. Interface adapter 16 facilitates electrical connection of the link cable 18 to an instrument connector 38, and suitably may include a cable termination block, such as a printed circuit board, into which instrument connector as well as the plurality of differential pairs and their shields are electrically connected. The connector personality module 20 likewise facilitates electrical connection of the link cable 18 to the network connector 24, the details of which will be discussed later in connection with FIG. 5. Both interface adapter 16 and connector personality module 20 each may suitably include an electrically-programmable write/read memory (EEPROM) 40 and 42, respectively. EEPROM 40 stores calibration data for the interface module 16 and link cable 18, while EEPROM 42 stores identification information and calibration data for the connector personality module 20. Together, they provide stored calibration data for interface link adapter 14. The stored calibration data is related to return loss over a range of frequencies of the link cable 18. Accordingly, the calibration data is different for each link interface cable assembly 14 primarily due to intrinsic return loss. The link cable 18 is manufactured to rigid specifications, as will be discussed shortly, and remains quite stable. Link cable 18 also may suitably include a multiple-wire data cable 44, such as a 6-wire ribbon cable, to allow the cable test instrument 10 to access the calibration data stored in the EEPROM 42. In operation, then, the cable test instrument 10 is calibrated up to the personality module 20 and does not need to rely on special techniques to account for patch cord return loss and crosstalk as did earlier instrumentation.

As an alternative, if only identification of personality module 42 is desired, EEPROM 42 could be replaced with some other component that will readily provide such information when interrogated, such as a latch or shift register, or even nothing more than a resistor of known value. In such a case the cable 44 could carry fewer or more wires to fit the particular situtation.

FIG. 3 is an illustration showing the construction details of a single shielded differential pair used for link cable 18 in an embodiment built and tested. A pair of wires 50 and 52 are juxtaposed in a dielectric medium 54, maintaining a constant side-by-side spatial relationship over the length of the link cable 18. Wires 50 and 52 in this embodiment are 26 American Wire Gauge (AWG) silver-plated stranded copper wire. The dielectric medium 54 is extruded polyethylene having a relative dielectric constant of approximately 2.28 between wires 50 and 52. The differential characteristic impedance is a nominal 100 ohms, while the common mode impedance is within a range of 28 to 38 ohms. DC resistance (at 20 degrees Celsius) is approximately 0.1 ohm per meter. The overall length is nominally 50 inches, but this length is non-critical and represents a compromise between having the cable too short for practical usage and too long for return-loss, crosstalk and attenuation reasons.

A first shield 56 and a second shield 58 are formed of polycarbonate material, such as Mylar, in tape form having a 0.92-mil overall nominal thickness, and having a 9-micron aluminum coating on one surface. The nominal width of the tape is 0.375 inch. The word "nominal" is used in this description to refer to the design specifications, and the actual dimensions may vary slightly. The first shield 56 is formed by spiral winding the tape counterclockwise around the dielectric medium 54 such that the aluminum coating is on the outside, with about 10% overlap on each turn. A shield drain wire 60, which is 26 AWG silver-plated solid copper, is disposed axially along the first shield 56 on one side of the differential pair 50-52. The second shield 58 is formed by spiral winding the tape clockwise around the first shield 56 and shield drain wire 60 such that the aluminum coating is on the inside, again with about 10% overlap on each turn. In other words, the aluminum coating on the two shields is in direct electrical contact with each other and the shield drain wire 60, forming a complete shield structure which is electrically connected to the ground plane both in the interface adapter 16 and connector personality module 20. This shielding minimizes crosstalk between differential pairs. A third shield 62 fabricated of magnetic material such as braided steel wire or iron-impregnated or iron-coated elastic material may be added to sheath the shielded differential pair to substantially reduce or eliminate altogether crosstalk and electromagnetic interference.

The shielded differential pair described above in accordance with an embodiment that was built and tested ensures a high-quality, light weight, and long lasting data transmission link for a wide range of frequencies. Other materials and shielding will occur to those having ordinary skill in the art, and may be used; however, performance may be degraded if care is not taken to ensure complete shielding with flexibility for long-lasting performance.

FIG. 4 is a cross sectional view of the link cable 18 portion of the interface cable assembly 14 of the present invention. Four identical shielded differential pairs 80 constructed as described in connection with FIG. 3 are arranged in juxtaposition relationship within an outer sheath or jacket 82 formed using conventional techniques, such as extrusion, of a resilient insulating material such as soft polyvinylchloride (PVC) in such a manner that the differential pair wires 50-52 for all four shielded differential pairs are oriented in a plane and the link cable 18 appears somewhat flat. This permits bending or flexing the link cable without permanently altering return loss properties or creating crosstalk faults. The shield pairs 80 may actually touch each other without adverse changes in electrical parameters, or they may be separated by a webbing of PVC material as shown.

A signal-wire ribbon cable 84 comprising six 28 AWG copper conductor wires, insulated with a soft PVC jacket and wrapped in tape is disposed along the cable on the opposite side of the shielded differential pairs from the shield drain wires 60. Ribbon cable 84 is connected at one end to interface adapter 16 and connected at the other end to personality module 20, and carries control and data signals for permitting test instrument 10 to communicate with the EEPROM 42 in personality module 20.

A prototype link cable having a length of 50 inches (1.27 meters) and the geometry as shown in FIG. 4 has been designed for operation over a range of one megahertz (MHz) to 350 MHz with specified limits for signal attenuation, crosstalk, and return loss parameters. The design limits for maximum signal attenuation ranges from 0.15 decibels (dB) at one MHz to 0.5 dB at 350 MHz. The design specification for crosstalk ranges from 85 dB at one MHz down to 79.6 dB at 350 MHz, while the specification for return loss ranges from 35 dB to 29.6 over the same frequency range. It is believed that frequency ranges up to 600 MHz or even higher are attainable in link cables fabricated as described herein.

FIG. 5 is an illustration showing the connection to the link cable 18 of a connector personality module 20. A termination block 100 is fixedly attached to the far end of link cable 18. Termination block 100 suitably may include a printed-circuit board 102 onto which a pair of spring-loaded contact assemblies 104 and 106 are soldered. All of the wires housed within link cable 18 are soldered into termination block 100 such as circuit board 102, with conductor runs electrically connecting the wires to the spring-loaded contact assemblies.

The connector personality module 20 may suitably include a printed circuit board having contact pads which correspond to the spring-loaded contacts of the termination block 100. EEPROM 42, mentioned earlier, may be mounted on the printed circuit board, and connector leads from connector 24, also mentioned earlier, are soldered to the circuit board. The pins of EEPROM 42 and the connector 24 leads are electrically connected to to the contact pads with conductor runs on the printed circuit board.

The termination block 100 receives the connector personality module 20 such that the spring-loaded contacts and contact pads are in alignment. Connector personality module 20 is secured to the termination block b a locking mechanism exemplified by screw 110 inserted between the spring-loaded contact assemblies. When screw 100 is tightened, equal pressure is distributed over the spring-loaded contacts, which compress and ensure good electrical contact. The spring-loaded contacts and contact pads are preferably gold plated to ensure a high-quality connector for passing high-frequency signals.

It will be understood by those skilled in the art that while four differential pairs of wire have been discussed for purposes of explanation in describing the link interface cable assembly in accordance with the present invention, a cable assembly could be fabricated with any number of differential pairs. Also, while a link cable fabricated with shielded differential pairs has been described herein, it is contemplated that shielded twisted pairs could be used with reduced performance, and it would be well within the purview of one having ordinary skill in the art to fabricate a link cable having a plurality of shielded twisted pairs arranged in juxtaposition to provide a flat cable. Another alternative would be to employ differential pairs that are spiraled to create hybrid differential-twisted pairs. However, it should be taken into account that any pair in which twisting or spiraling is employed creates a situation in which the pairs will be stressed when the cable is coiled, resulting in accumulated changes in electrical characteristics.

Accordingly, it can be discerned that the resulting link interface cable assembly exhibits minimum crosstalk and is a long lasting and reliable "flat" cable that can be flexed or bent without unduly stressing the differential pairs or permanently changing cable performance characteristics. Calibration data stored in both the interface adapter and the connector personality module permit "patch cord" intrinsic return loss to be effectively removed from network cable measurements over a wide range of frequencies. Moreover, the link interface cable assembly features interchangeability of connector personality modules while always being calibrated up to the network port.

While I have shown and described the preferred embodiment of my invention, it will be apparent to those skilled in the art that many changes and modifications may be made without departing from my invention in its broader aspects. It is therefore contemplated that the appended claims will cover all such changes and modifications as fall within the true scope of the invention.

What I claim as my invention is:

1. A cable assembly, comprising:

a plurality of differential pair cables arranged in juxtaposition relationship to form a flat link cable having a first end and a second end; and an outer sheath of insulating material formed around said plurality of differential pair cables, each of said plurality of differential pair cables comprising two wires arranged in juxtaposition relationship and disposed in an individual dielectric medium which embeds said two wires of only one of said plurality of differential pair cables in constant spatial relationship over a length, and a metallic shield disposed around an outer surface of each of said individual dielectric medium.

2. A cable assembly in accordance with claim 1 wherein said metallic shield comprises a first shield formed by wrapping a tape having at least one metallic surface in a first direction around each of said individual dielectric medium, and a second shield formed by wrapping said tape having at least one metallic surface in a second direction around said first shield such that said metallic surfaces are in contact with each other.

3. A cable assembly in accordance with claim 2 further comprising a drain wire disposed between said first shield and said second shield in electrical contact with said metallic surfaces.

4. A cable assembly in accordance with claim 2 further comprising a third shield of magnetic material disposed outside of said first and second shield.

5. A cable assembly in accordance with claim 1 further comprising an interface adapter electrically connected to said first end of said link cable, said interface adapter including a connector for connecting with a cable test instrument.

6. A cable assembly in accordance with claim 5 wherein said interface adapter also includes a memory containing calibration data relating to intrinsic return loss in said link cable.

7. A cable assembly in accordance with claim 1 further comprising a personality module electrically connected to said second end of said link cable, said personality module having a connector for connecting with a network port.

8. A cable assembly in accordance with claim 7 wherein said personality module is releasably attached to said second end of said link cable.

9. A cable assembly in accordance with claim 8 wherein said personality module is one of a plurality of interchangeable personality modules each having characteristics to match a specific network port.

10. A cable assembly in accordance with claim 9 wherein said personality module includes a memory device containing stored information relating to said network connector, and wherein said link cable further includes a data cable extending along said plurality of differential pair cables with one end of said data cable electrically connectible to said memory device and the other end of said data cable electrically connectible to a cable test instrument.

* * * * *